US012509207B2

(12) United States Patent
Kimpara et al.

(10) Patent No.: US 12,509,207 B2
(45) Date of Patent: Dec. 30, 2025

(54) OPERATION APPARATUS FOR SHIP PROPULSION MACHINE

(71) Applicant: SUZUKI MOTOR CORPORATION, Hamamatsu (JP)

(72) Inventors: Masatoshi Kimpara, Hamamatsu (JP); Yuta Eto, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 756 days.

(21) Appl. No.: 17/743,243

(22) Filed: May 12, 2022

(65) Prior Publication Data

US 2022/0363360 A1 Nov. 17, 2022

(30) Foreign Application Priority Data

May 17, 2021 (JP) ..... 2021-083137

(51) Int. Cl.
*B63H 21/21* (2006.01)
*B63H 20/00* (2006.01)

(52) U.S. Cl.
CPC ..... *B63H 21/213* (2013.01); *B63H 20/00* (2013.01); *B63H 2021/216* (2013.01)

(58) Field of Classification Search
CPC ..... B63H 21/213; B63H 20/00; B63H 2021/216; B63H 25/42; B63H 2025/022; B63H 20/12
See application file for complete search history.

(56) References Cited

U.S. PATENT DOCUMENTS

| | | | | |
|---|---|---|---|---|
| 6,587,765 | B1 | 7/2003 | Graham et al. | 701/21 |
| 12,030,607 | B1 * | 7/2024 | Kirchhoff | B63B 79/40 |
| 2010/0305789 | A1 * | 12/2010 | Ito | B63H 21/213 700/21 |
| 2017/0221657 | A1 * | 8/2017 | Barker | A63B 22/0605 |
| 2018/0134362 | A1 * | 5/2018 | Despineux | B63H 21/213 |

FOREIGN PATENT DOCUMENTS

| | | | |
|---|---|---|---|
| JP | 2014-237399 | A | 12/2014 |
| KR | 10-2012-0113920 | A | 10/2012 |

OTHER PUBLICATIONS

Japanese Office Action mailed Nov. 26, 2024, issued to Japanese Patent Application No. 2021-083137.

* cited by examiner

*Primary Examiner* — Andrew Polay
(74) *Attorney, Agent, or Firm* — Stein IP, LLC

(57) ABSTRACT

An operation apparatus configured to operate a ship propulsion machine includes: a remote control device including a holder and an operation lever swingably supported, and configured to perform a shift switching operation of the ship propulsion machine and an operation of increasing/decreasing a rotation speed of a power source of the ship propulsion machine; a gauge device including a display device and configured to display information regarding the ship propulsion machine including information indicating a shift position of the ship propulsion machine and the rotation speed of the power source; and a case to which the remote control device and the gauge device are each attached, and which integrates the remote control device and the gauge device. In the case, the remote control device and the gauge device are disposed adjacently to each other in a front-rear direction of the ship.

5 Claims, 10 Drawing Sheets

OPERATION APPARATUS FOR SHIP PROPULSION MACHINE

CROSS-REFERENCE TO RELATED APPLICATIONS

The disclosure of Japanese Patent Application No. 2021-083137 filed on May 17, 2021, including specification, drawings and claims is incorporated herein by reference in its entirety.

BACKGROUND

The present invention relates to an operation apparatus that operates a ship propulsion machine.

A ship is provided with a ship propulsion machine that propels the ship. A console of the ship is provided with a plurality of devices for operating the ship. Examples of the devices provided on the console include a steering device that performs a steering operation of the ship, a remote control device that performs a shift switching operation of the ship propulsion machine and an operation of increasing/decreasing a rotation speed of a power source of the ship propulsion machine, the ship propulsion machine, a gauge device that displays various kinds of information on the ship and navigation, a start switch that starts the power source of the ship propulsion machine, and an emergency stop switch that stops the power source of the ship propulsion machine in an emergency such as when a ship operator falls into water. The following patent literature describes an example of the remote control device.

Patent Literature 1: JP-A-2014-237399

SUMMARY

In order to solve the above problems, the invention is an operation apparatus configured to operate a ship propulsion machine provided in a ship, and the operation apparatus includes: a remote control device including a holder and an operation lever swingably supported by the holder, and configured to perform, by the operation lever, a shift switching operation of the ship propulsion machine and an operation of increasing/decreasing a rotation speed of a power source of the ship propulsion machine; a gauge device including a display device and configured to display, on the display device, information on the ship propulsion machine including information indicating a shift position of the ship propulsion machine and information indicating the rotation speed of the power source; and a case to which the remote control device and the gauge device are each attached, and which integrates the remote control device and the gauge device. In the case, the remote control device and the gauge device are disposed adjacently to each other in a front-rear direction of the ship.

BRIEF DESCRIPTION OF DRAWINGS

FIG. 2A is a view illustrating a state in which the operation apparatus is attached to the console, and FIG. 2B is a view illustrating a state in which the operation apparatus is not attached to the console shown in FIG. 2A.

FIG. 3 is a view illustrating a state in which the operation apparatus according to the first embodiment of the invention is viewed from an upper left rear side, and information on an outboard motor displayed on a display device in a gauge device of the operation apparatus, and the like.

FIG. 10A is a view illustrating a state in which the independent remote control device, the independent gauge device, and the independent emergency stop switch are separately attached to the console, and FIG. 10B is a view illustrating a state in which the independent remote control device, the independent gauge device, and the independent emergency stop switch are not attached to the console of FIG. 10A.

DESCRIPTION OF EMBODIMENTS

Figure 1:
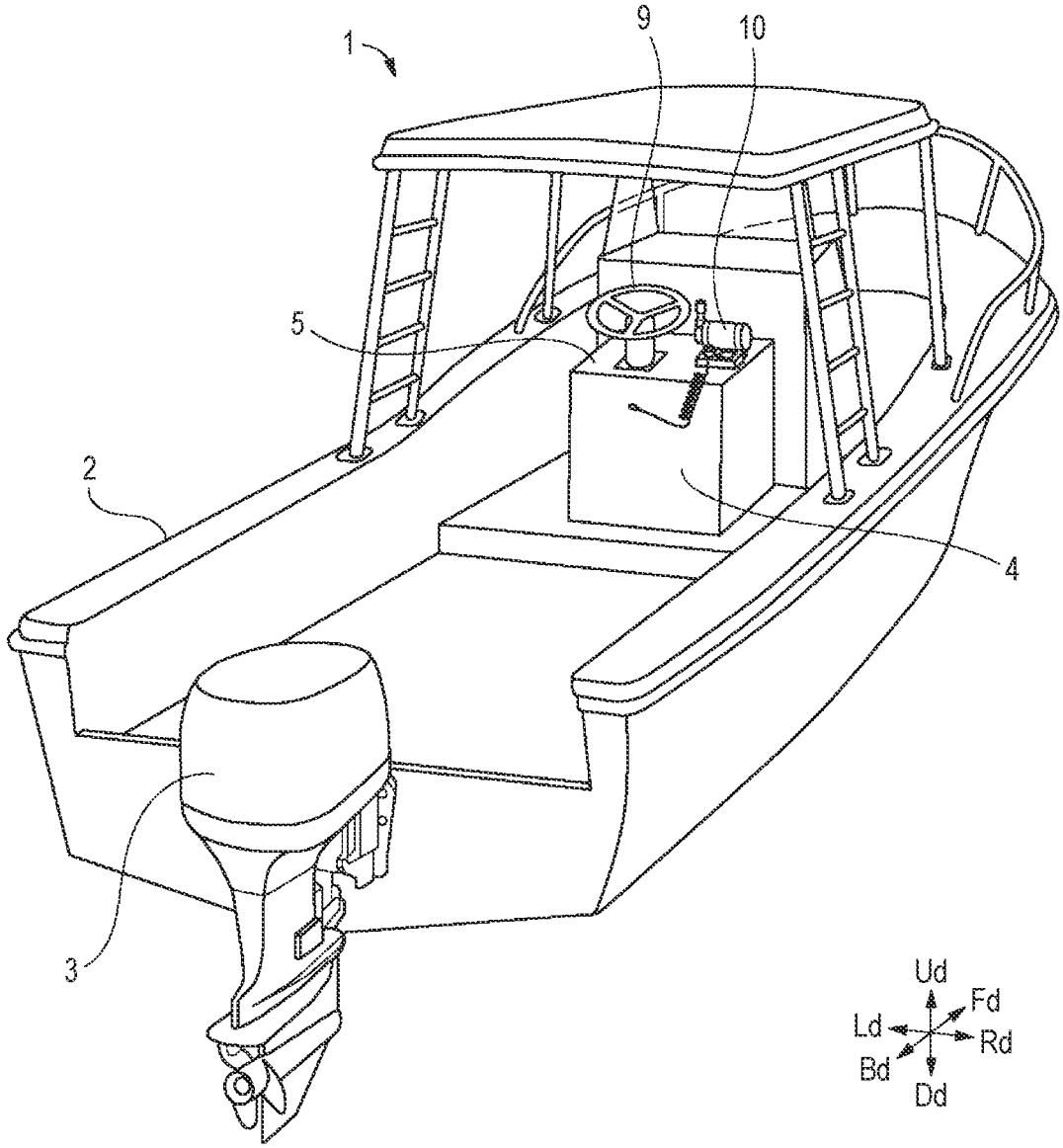
FIG. 1 is a perspective view showing a ship provided with an operation apparatus according to a first embodiment of the invention, as viewed from an upper right rear side.

In the related art, the plurality of devices for operating the ship are independent devices, and is separately disposed on an attachment surface of the console. Therefore, an overall attachment area required for attaching these devices to the attachment surface of the console is increased. As a result, when these devices are attached to the console, a large console having a wide attachment surface is required. It is not preferable to increase a size of the console in a small ship.

In addition, when a plurality of independent devices for operating the ship are separately disposed on the attachment surface of the console, an operation area for the ship operator operating the ship is widened, and as a result, a distance for the ship operator moving his/her arm to operate the ship is increased. For example, when the gauge device is disposed on a right side of the steering device and the remote control device is disposed on a right side of the gauge device on the attachment surface of the console, a distance between the steering device and the remote control device increases since the gauge device is disposed between the steering device and the remote control device. Therefore, when the steering operation by the steering device, the shift switching operation by the remote control device, and the like are alternately performed, the ship operator needs to greatly move the right arm in a left-right direction, resulting in poor operability. In addition, while the right arm repeats the great movement in this manner, a cord connecting the right arm of the ship operator and the emergency stop switch may be entangled, and the operability may be further deteriorated.

In addition, when the plurality of devices for operating the ship are separately disposed on the attachment surface of the console, attachment work of attaching these devices to the attachment surface of the console becomes complicated. Specifically, in order to attach the device for operating the ship to the attachment surface of the console, it is necessary to provide a hole through which a fixing member (for example, a bolt) for fixing the device to the attachment surface of the console passes, a hole through which a cable connected to the device passes, and the like in the attachment surface of the console. When the plurality of devices for operating the ship are separately disposed on the attachment surface of the console, it is necessary to provide the hole through which the fixing member passes and the hole through which the cable passes on the attachment surface of the console for each device for operating the ship. Therefore, it is necessary to provide a large number of holes in the attachment surface of the console. As a result, the attachment work of attaching the devices for operating the ship to the attachment surface of the console becomes complicated.

The invention has been made in view of, for example, the above-described problems, and an object of the invention is to provide an operation apparatus capable of reducing an overall attachment area of a plurality of devices for operating a ship, and being excellent in operability or capable of improving attachment workability.

According to the invention, it is possible to reduce an overall attachment area of a plurality of devices for operating a ship, to improve operability, or to improve attachment workability.

An operation apparatus according to an embodiment of the invention is an operation apparatus that operates a ship propulsion machine provided in a ship, and includes a remote control device and a gauge device. The remote control device includes a holder and an operation lever swingably supported by the holder, and the operation lever is used to perform a shift switching operation of the ship propulsion machine and an operation of increasing/decreasing a rotation speed of a power source of the ship propulsion machine. The gauge device is a device including a display device and displaying information on the ship propulsion machine on the display device. The information on the ship propulsion machine includes information indicating a shift position of the ship propulsion device and information indicating the rotation speed of the power source of the ship propulsion machine.

The operation apparatus according to the embodiment of the invention further includes a case to which the remote control device and the gauge device are each attached, thereby integrating the remote control device and the gauge device. Further, in this case, the remote control device and the gauge device are disposed adjacently to each other in a front-rear direction of the ship.

According to the operation apparatus of the embodiment of the invention, by attaching the case in which the remote control device and the gauge device are integrated to an attachment surface of a console, the remote control device and the gauge device can be provided on the attachment surface of the console. According to the operation apparatus of the embodiment of the invention, since the remote control device and the gauge device are aggregated into one case so as to be integrated, an attachment area required for attaching this case to the attachment surface of the console can be reduced as compare with an overall attachment area required for attaching the independent remote control device and the independent gauge device separately from each other to the attachment surface of the console. As a result, it is possible to prevent an increase in size of the console.

Further, according to the operation apparatus of the embodiment of the invention, in addition to the remote control device and the gauge device being aggregated via the case so as to be integrated, the remote control device and the gauge device are disposed adjacently to each other in the front-rear direction of the ship, and thus, an operation area for a ship operator operating the ship can be reduced, and a distance for the ship operator moving his/her arm to operate the ship can be reduced.

Specifically, by disposing the operation apparatus according to the embodiment of the invention on the attachment surface of the console on a lateral side of a steering device so as to be close to the steering device, it is possible to reduce a distance between the steering device and the remote control device while providing the remote control device and the gauge device on the attachment surface of the console. That is, in the operation apparatus according to the embodiment of the invention, since the remote control device and the gauge device are disposed adjacently to each other in the front-rear direction of the ship, when the operation apparatus is disposed on the lateral side of the steering device, the gauge device is not positioned between the steering device and the remote control device. Therefore, the distance between the steering device and the remote control device can be reduced by disposing the operation apparatus on the lateral side of the steering device so as to be close to the steering device. When the distance between the steering device and the remote control device is reduced, a distance by which the arm moves to left or right when the ship operator alternately performs a steering operation by the steering device, the shift switching operation by the remote control device, and the like decreases, thereby improving operability. In addition, even when the ship operator repeats the movement of the arm in order to alternately perform the steering operation, the shift switching operation, and the like, the movement of the arm is reduced, and thus a cord connecting the arm of the ship operator and an emergency stop switch is less likely to be entangled.

In addition, according to the operation apparatus of the embodiment of the invention, by attaching the case of the operation apparatus to the attachment surface of the console, the remote control device and the gauge device integrated via the case can be provided on the attachment surface of the console, and thus it is possible to improve workability of attaching the remote control device and the gauge device to the console.

Specifically, in the above-described technique in the related art, since the remote control device and the gauge device are separated from each other, it is necessary to separately attach the remote control device and the gauge device to the attachment surface of the console. In order to each attach the remote control device and the gauge device to the attachment surface of the console, it is necessary to provide, in the attachment surface, a hole through which a fixing member (for example, a bolt) for fixing the remote control device to the attachment surface passes and a hole through which a fixing member for fixing the gauge device to the attachment surface passes. In contrast, in the operation apparatus according to the embodiment of the invention, the remote control device and the gauge device are integrated via the case. Therefore, in order to attach the remote control device and the gauge device to the attachment surface of the console, the attachment surface may be provided with a hole through which a fixing member for fixing the case via which the remote control device and the gauge device are integrated to the attachment surface passes. Therefore, the number of holes provided in the attachment surface of the console for fixing the device can be reduced.

Further, when the remote control device and the gauge device are separated from each other as in the related art described above, when the remote control device and the gauge device are each attached to the attachment surface of the console, it is necessary to separately provide, on the attachment surface, a hole through which a cable for the remote control device connected to the remote control device passes and a hole through which a cable for the gauge device connected to the gauge device passes. In contrast, in the operation apparatus of the embodiment of the invention, the remote control device and the gauge device are integrated via the case, and thus, it is easy to bundle and integrate the cable for the remote control device connected to the remote control device and the cable for the gauge device connected to the gauge device. Therefore, when the case via which the remote control device and the gauge device are integrated is attached to the attachment surface of the console, it is sufficient to provide one hole through which an integrated cable (harness) passes in the attachment surface. Therefore, it is possible to reduce the number of holes provided in the attachment surface of the console through which the cables connected to the devices pass.

As described above, according to the operation apparatus of the embodiment of the invention, since the number of holes provided in the attachment surface of the console can be reduced, it is possible to reduce work quantity of the attachment work of attaching the remote control device and the gauge device to the attachment surface, and it is possible to improve the workability of the attachment work.

Embodiments

Hereinafter, some embodiments of an operation apparatus of the invention will be described with reference to the drawings. In each embodiment, when front (Fd), rear (Rd), left (Ld), right (Rd), upper (Ud), and lower (Dd) directions are described, the directions follow arrows drawn at a lower right portion of each drawing except for FIG. 7.

(Configurations of Ship, Outboard Motor, and Operation Apparatus)

FIG. 1 shows a ship 1 provided with an operation apparatus 10 according to a first embodiment of the invention, as viewed from an upper right rear side. In FIG. 1, the ship 1 according to the present embodiment is a small ship having a fixed capacity of, for example, about 5 to 10 persons. An outboard motor 3 serving as a ship propulsion machine that propels the ship 1 is attached to a rear portion of a hull 2 of the ship 1. The outboard motor 3 according to the present embodiment includes an engine (internal combustion engine) as a power source thereof.

The hull 2 is provided with a console 4. In the present embodiment, the console 4 is disposed substantially at a center of a deck of the hull 2 in a front-rear direction and in a left-right direction. A steering wheel 9 serving as a steering device and the operation apparatus 10 are attached to an attachment surface 5 formed on an upper surface of an upper plate of the console 4. The steering wheel 9 is a device for performing a steering operation of the ship 1. The operation apparatus 10 is a device in which a remote control device 11 that performs a shift switching operation of the outboard motor 3 and an operation of increasing/decreasing a rotation speed of the engine of the outboard motor 3, a gauge device 31 that displays information on the outboard motor 3 and the like, and an emergency stop switch 51 that performs emergency stop on the engine of the outboard motor 3 are integrated.

The ship 1 according to the present embodiment is not provided with a seat for a ship operator to sit in front of the console 4. The ship operator stands in front of the console 4 and operates the ship. Note that the seat for the ship operator to sit on may be provided in front of the console 4, and the ship operator may sit on the seat to operate the ship.

Figure 2A:
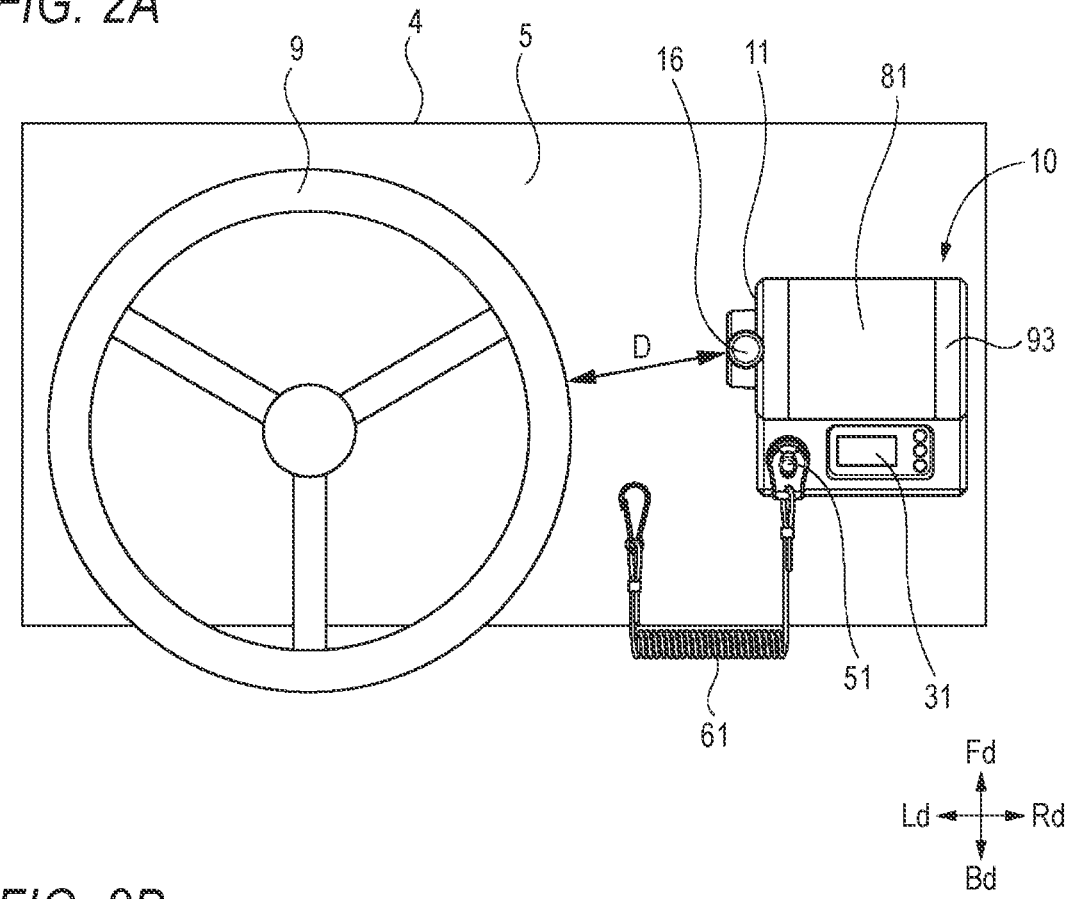
FIGS. 2A and 2B illustrate views of states in which a console of the ship in FIG. 1 is viewed from an upper side, more specifically.
Figure 2B:
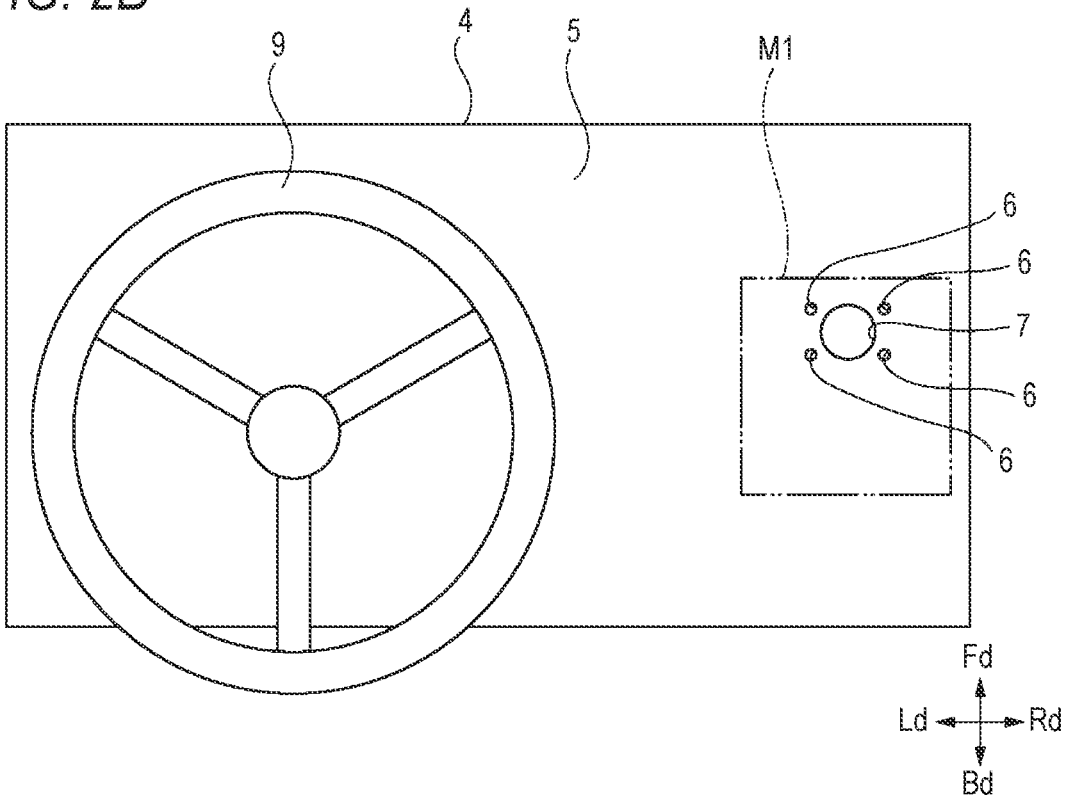

FIGS. 2A and 2B show the attachment surface 5 of the console 4 as viewed from an upper side. Specifically, FIG. 2A shows a state in which the operation apparatus 10 is attached to the attachment surface 5, and FIG. 2B shows a state in which the operation apparatus 10 is not yet attached to the attachment surface 5 to which the operation apparatus 10 is to be attached as shown in FIG. 2A. As shown in FIG. 2A, the operation apparatus 10 is a top-mount type of operation apparatus that is attached to the attachment surface 5 on the upper surface of the console 4. The operation apparatus 10 is disposed on a lateral side of the steering wheel 9, specifically, on a right side of the steering wheel 9, on the attachment surface 5 of the console 4. Further, as shown in FIG. 2B, a plurality of (for example, four) fixing bolt insertion holes 6 through which fixing bolts 95 (see FIG. 5) as fixing members that fixes a case 81 of the operation apparatus 10 to the attachment surface 5 are inserted are provided in the upper plate of the console 4 on which the attachment surface 5 is formed. One harness insertion hole 7 through which a harness 72 (see FIG. 5) connected to the operation apparatus 10 passes is further provided in the upper plate of the console 4.

(Operation Apparatus)

Figure 3:
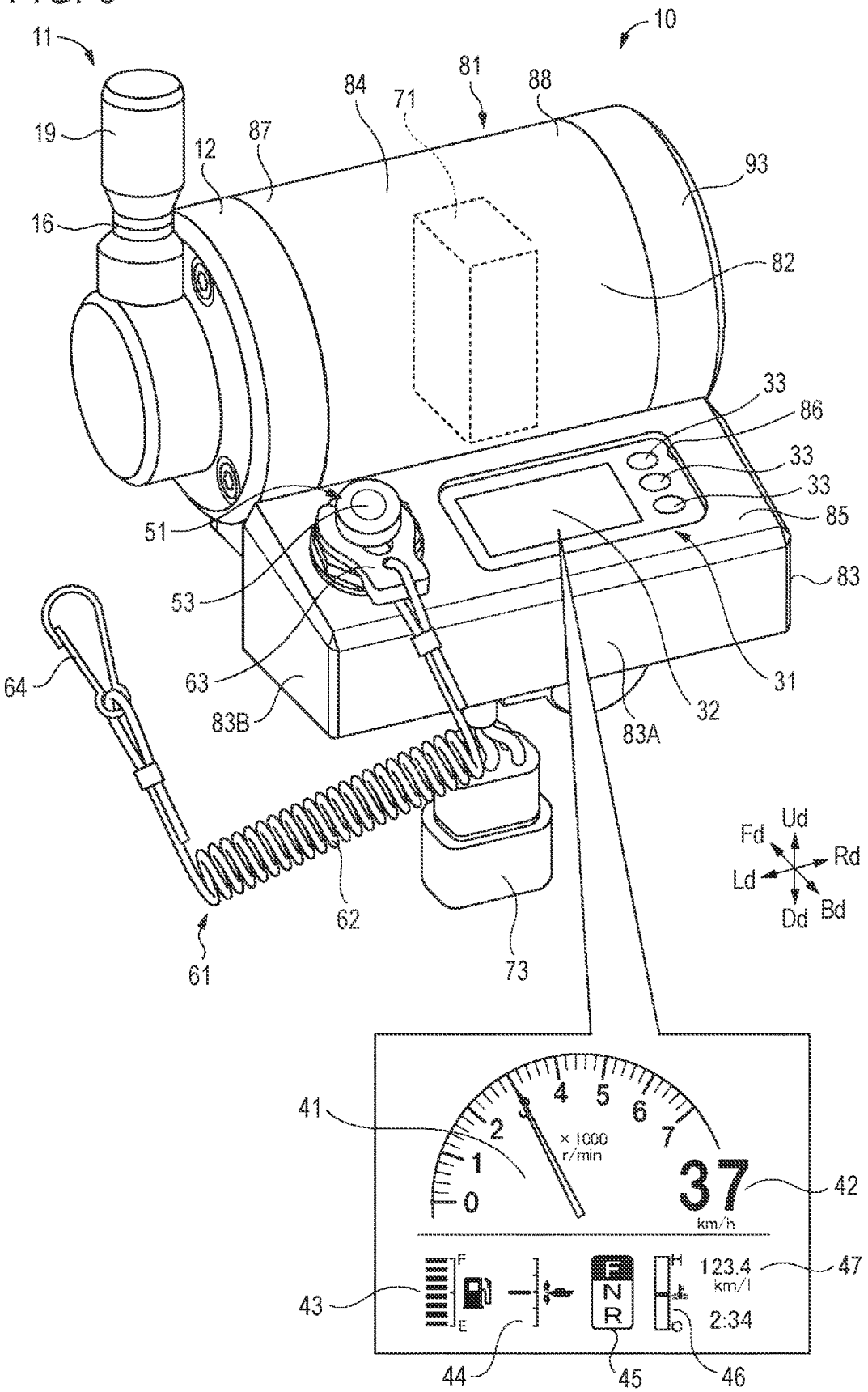
Figure 4:
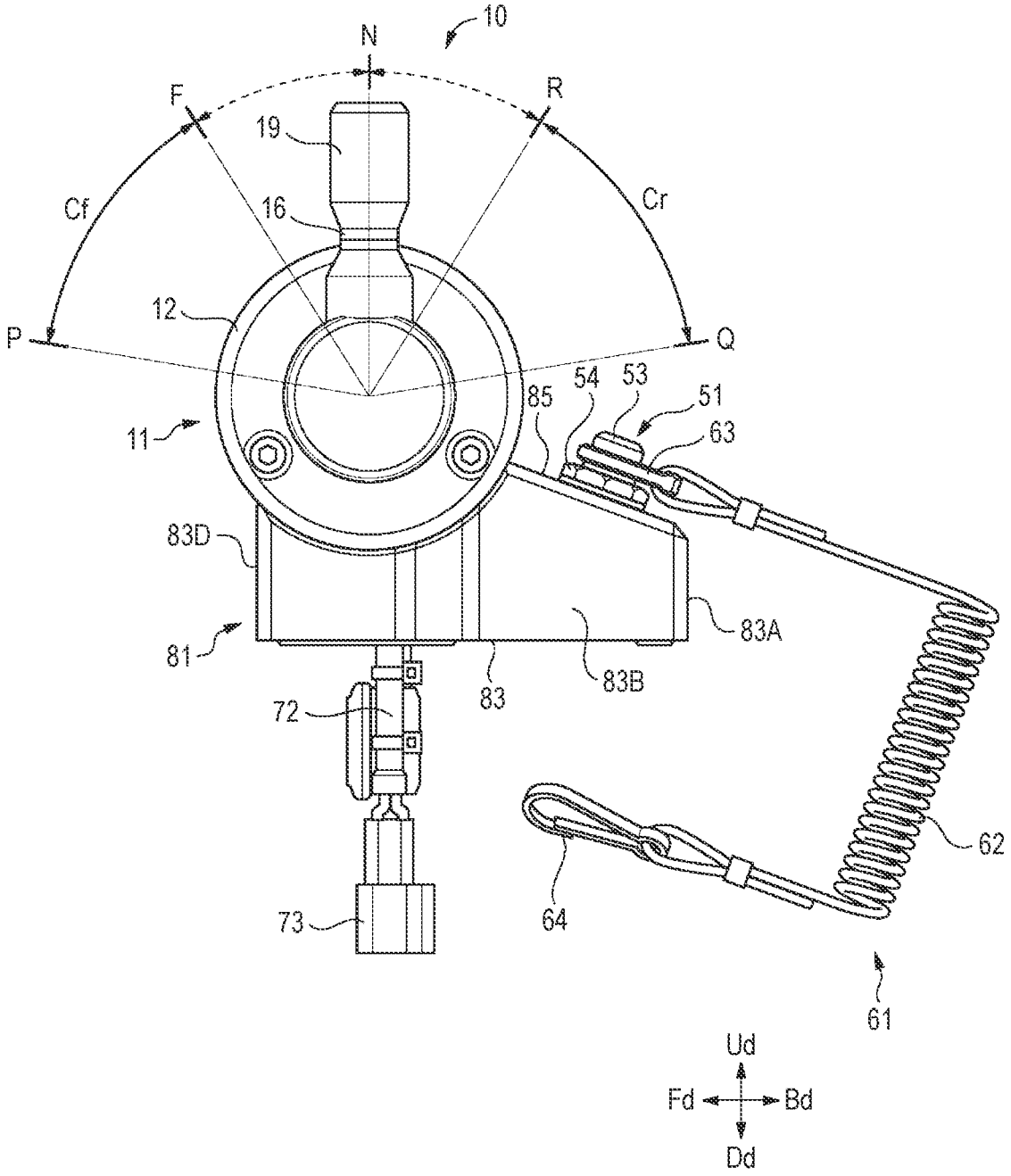
FIG. 4 is a view illustrating a state in which the operation apparatus according to the first embodiment of the invention is viewed from a left side, and a shift operation position and a rotation speed operation range of a remote control device of the operation apparatus.
Figure 5:
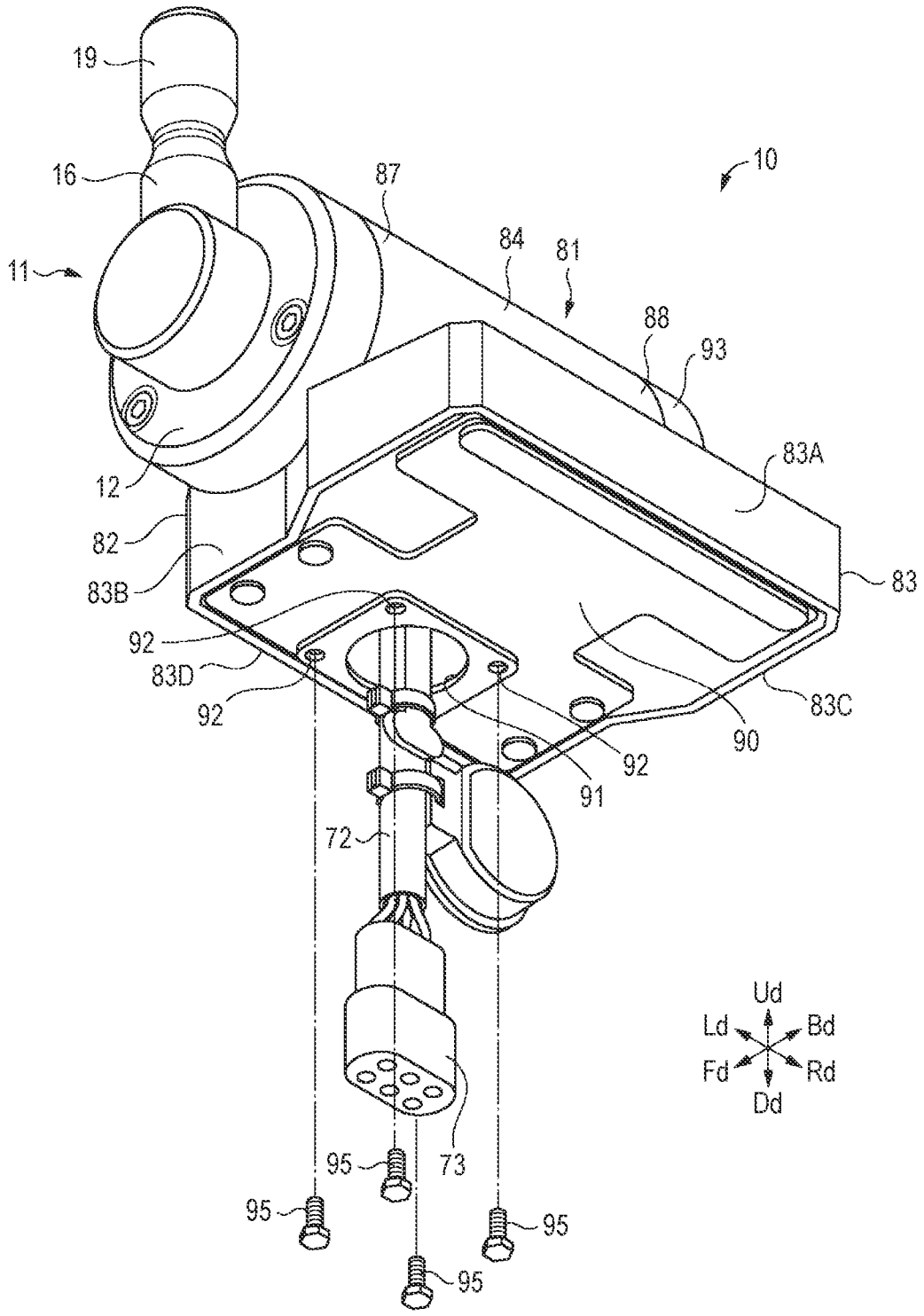
FIG. 5 is a perspective view showing the operation apparatus according to the first embodiment of the invention as viewed from a lower left rear side.
Figure 6:
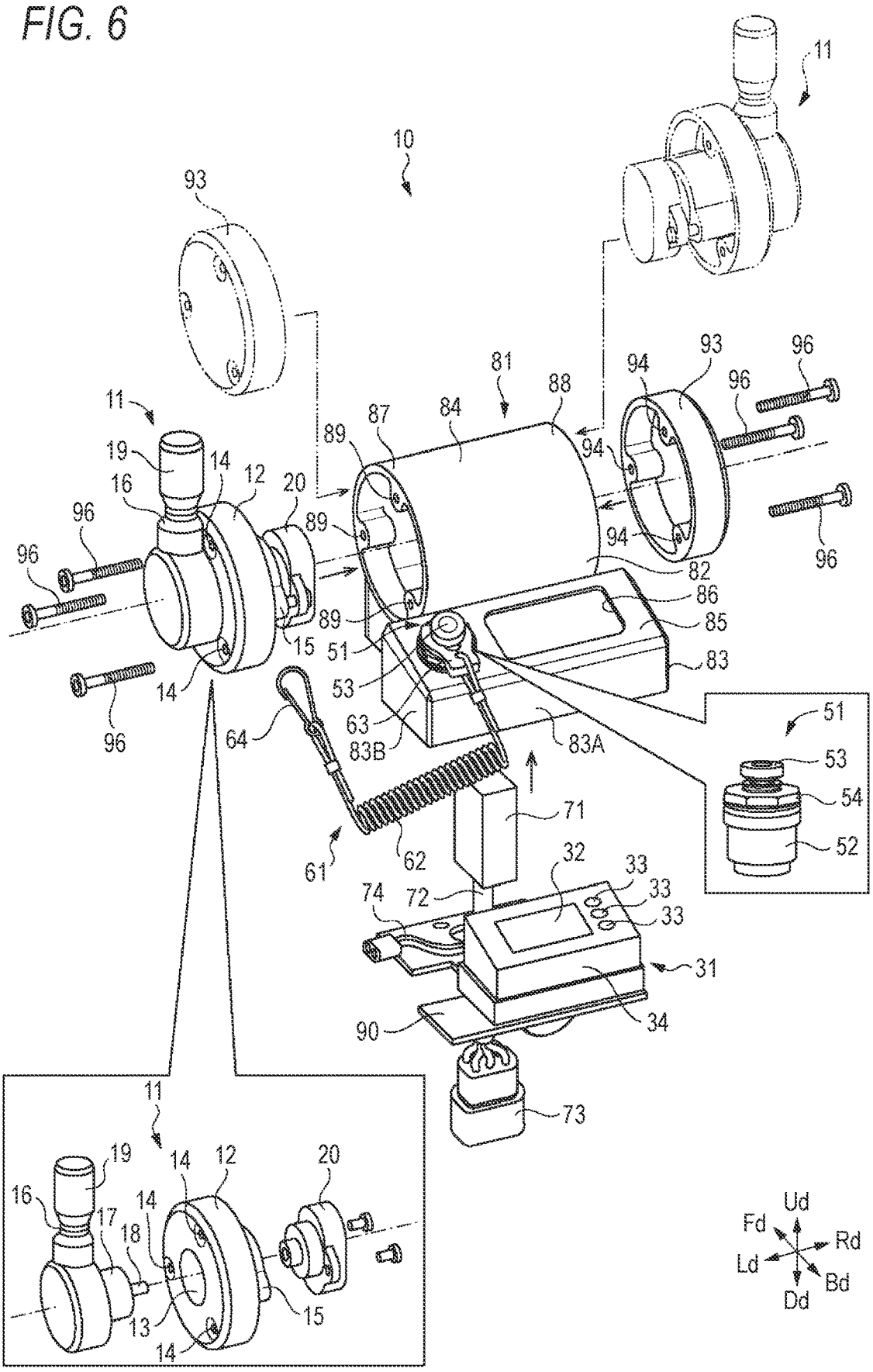
FIG. 6 is an exploded perspective view of the operation apparatus according to the first embodiment of the invention.
Figure 7:
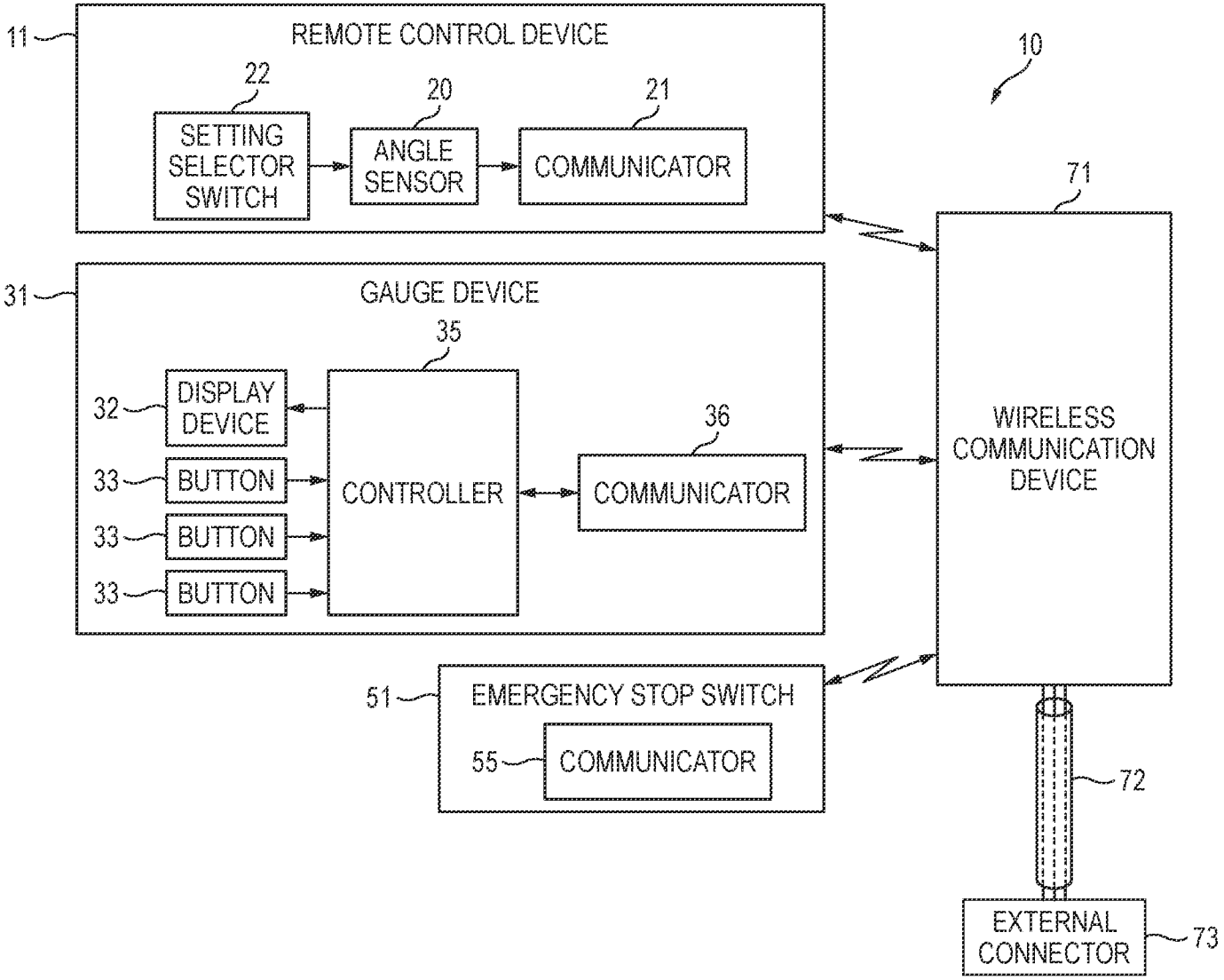
FIG. 7 is a block diagram showing an electrical configuration of the operation apparatus according to the first embodiment of the invention.

FIG. 3 shows the operation apparatus 10 as viewed from an upper left rear side. Further, on a lower side in FIG. 3, information on the outboard motor 3 and the like displayed on a display device 32 of the gauge device 31 of the operation apparatus 10 are shown. FIG. 4 shows the operation apparatus 10 as viewed from a left side. In addition, in FIG. 4, shift operation positions N, F, R and rotation speed operation ranges Cf, Cr of the remote control device 11 of the operation apparatus 10 are shown. FIG. 5 shows the operation apparatus 10 as viewed from a lower left rear side. FIG. 6 shows a state in which the operation apparatus 10 is disassembled. On a lower left side in FIG. 6, a state in which the remote control device 11 is disassembled is shown. In addition, on a right side of FIG. 6, the emergency stop switch 51 in a state of being separated from the case 81 is shown. FIG. 7 shows an electrical configuration of the operation apparatus 10.

As shown in FIG. 3, the operation apparatus 10 includes the remote control device 11, the gauge device 31, the emergency stop switch 51, a wireless communication device 71, the case 81, and a cap 93.

(Remote Control Device)

The remote control device 11 is a device that performs the shift switching operation of the outboard motor 3 and the operation of increasing/decreasing the rotation speed of the engine of the outboard motor 3. As shown in FIG. 6, the remote control device 11 includes a holder 12, an operation lever 16 swingably supported by the holder 12, and an angle sensor 20 that detects a swing angle (inclination angle) of the operation lever 16 with respect to the holder 12. As shown in FIG. 7, the remote control device 11 further includes a communicator 21 that wirelessly transmits a signal corresponding to the swing angle of the operation lever 16 with respect to the holder 12 to the wireless communication device 71. The remote control device 11 further includes a setting selector switch 22 that switches setting of the forward movement position F, the reverse movement position R, the rotation speed operation range Cf. and the rotation speed operation range Cr.

As shown in the lower left side of FIG. 6, the holder 12 is formed in a cylindrical shape with a lid. The operation lever 16 is provided on a left side of the holder 12. The operation lever 16 is formed in a substantially rod shape, and a shaft portion 17 is provided at a side portion of a base end of the operation lever 16. The shaft portion 17 is inserted into a shaft insertion hole 13 formed in the holder 12, and is rotatably supported in the shaft insertion hole 13. As a result, the operation lever 16 swings with respect to the holder 12 with the side portion of the base end thereof as a fulcrum. The shaft portion 17 is provided with an output shaft 18 for transmitting the swing angle of the operation lever 16 to the angle sensor 20. A grip 19, which is held by the ship operator's hand, is provided at aside portion of a distal end of the operation lever 16. The angle sensor 20 is provided on a right side of the holder 12, and is fixed to a sensor fixing portion 15 formed on the holder 12 using a screw or the like. The output shaft 18 of the operation lever 16 is connected to the angle sensor 20.

The communicator 21 is attached to, for example, the angle sensor 20. As shown in FIG. 7, the angle sensor 20 is electrically connected to the communicator 21. The angle sensor 20 detects the swing angle of the operation lever 16 with respect to the holder 12, and outputs a detection signal indicating the detected swing angle to the communicator 21. The communicator 21 wirelessly transmits the detection signal output from the angle sensor 20 to the wireless communication device 71. The outboard motor 3 is provided with an engine control module (ECM) that controls the engine of the outboard motor 3, and as will be described later, the wireless communication device 71 is connected to the ECM via a signal transmission path provided in the ship 1. The detection signal wirelessly transmitted from the communicator 21 is received by the wireless communication device 71 and transmitted from the wireless communication device 71 to the ECM via the signal transmission path.

In FIG. 4, a range from the position N to the position P and a range from the position N to the position Q are ranges in which the operation lever 16 can swing, that is, ranges in which the ship operator can tilt the operation lever 16. These three shift operation positions, that is, the neutral position N, the forward movement position F, and the reverse movement position R are set within a swingable range of the operation lever 16. In addition, the rotation speed operation range Cf that is a swing range of the operation lever 16 in which the operation of increasing/decreasing the rotation speed of the engine is performed in a direction in which the ship 1 moves forward and the rotation speed operation range Cr that is a swing range of the operation lever 16 in which the operation of increasing/decreasing the rotation speed of the engine is performed in a direction in which the ship 1 moves backward are set within the swingable range of the operation lever 16.

When the operation lever 16 is at the neutral position N, a detection signal indicating, for example, 0 degree is output from the angle sensor 20 to the communicator 21, and the detection signal is transmitted to the ECM of the outboard motor 3 via the communicator 21, the wireless communication device 71, and the signal transmission path. The ECM releases connection of gears between the engine and a propeller shaft of the outboard motor 3 based on the detection signal. As a result, rotation of a propeller is stopped in a state where the engine of the outboard motor 3 operates, and the ship 1 is stopped.

When the ship operator tilts the operation lever 16 to a far side (bow side) and the operation lever 16 is at the forward movement position F, a detection signal indicating, for example, 30 degrees is output from the angle sensor 20 to the communicator 21, and the detection signal is transmitted to the ECM of the outboard motor 3 via the communicator 21, the wireless communication device 71, and the signal transmission path. The ECM connects the gears between the engine and the propeller shaft of the outboard motor 3 based on the detection signal, so that the propeller of the outboard motor 3 rotates in a forward direction. As a result, the propeller rotates in the forward direction, and the ship 1 moves forward at a minimum speed.

When the ship operator tilts the operation lever 16 to a near side (stem side) and the operation lever 16 is at the reverse movement position R, a detection signal indicating, for example, −30 degrees is output from the angle sensor 20 to the communicator 21, and the detection signal is transmitted to the ECM of the outboard motor 3 via the communicator 21, the wireless communication device 71, and the signal transmission path. The ECM connects the gears between the engine and the propeller shaft of the outboard motor 3 based on the detection signal, so that the propeller of the outboard motor 3 rotates in a reverse direction. As a result, the propeller rotates in the reverse direction, and the ship 1 moves reversely at a minimum speed.

(Gauge Device)

The gauge device 31 is a device that displays information on the outboard motor 3, and the like. As shown in FIG. 6, the gauge device 31 includes the display device 32 for displaying information, a plurality of buttons 33 for the ship operator to operate the gauge device 31, and a gauge housing 34. The display device 32 is configured to display characters and images, and is, for example, a liquid crystal display device or an organic electroluminescence display device. The display device 32 is attached to the gauge housing 34, so that a display screen thereof can be visually recognized from the outside. Each button 33 is attached to the gauge housing 34, so that the buttons 33 can be operated from the outside.

As shown in FIG. 7, the gauge device 31 further includes a controller 35 and a communicator 36. The controller 35 and the communicator 36 are provided in the gauge housing 34. The display device 32, the buttons 33, and the communicator 36 are electrically connected to the controller 35. The controller 35 includes a central processing unit (CPU), and in accordance with an operation of each button 33, performs control to switch information to be displayed on the display device 32, and the like. The communicator 36 receives information wirelessly transmitted from the wireless communication device 71 and outputs the information to the controller 35.

The ECM of the outboard motor 3 is configured to transmit information on the outboard motor 3 to the wireless communication device 71 via the signal transmission path provided in the ship 1. The wireless communication device 71 wirelessly transmits the information on the outboard motor 3 transmitted from the ECM to the communicator 36. The communicator 36 receives the information on the outboard motor 3 wirelessly transmitted from the wireless communication device 71, and outputs the received information on the outboard motor 3 to the controller 35. The controller 35 outputs the information on the outboard motor 3 output from the communicator 36 to the display device 32. The information on the outboard motor 3 is displayed on the display device 32 in this manner.

As shown on the lower side in FIG. 3, the information on the outboard motor 3 that can be displayed by the gauge device 31 includes an engine rotation speed 41 of the outboard motor 3, a speed 42 of the ship 1, a remaining fuel amount 43, a trim angle 44 of the outboard motor 3, a shift position 45 of the outboard motor 3, an engine temperature 46 of the outboard motor 3, an instantaneous fuel consumption 47, and the like. The gauge device 31 can also display information such as water temperature, temperature, longitude/latitude, and time in addition to the information on the outboard motor 3.

(Emergency Stop Switch)

The emergency stop switch 51 is a switch that performs emergency stop on the engine of the outboard motor 3. As shown on the right side in FIG. 6, the emergency stop switch 51 includes a switch housing 52 accommodating a contact mechanism and the like, a movable portion 53 supported by the switch housing 52 so as to be movable in an upper-lower direction, and a fixing nut 54 that fixes the switch housing 52 to the case 81. The movable portion 53 is biased downward by a biasing member such as a spring provided in the switch housing 52.

A cord unit 61 is attached to the emergency stop switch 51. The cord unit 61 is an instrument that connects the emergency stop switch 51 and the ship operator. The cord unit 61 includes an extendable cord 62 formed in a coil spring shape, a lock plate 63 connected to one end portion of the cord 62, and a hook 64 connected to the other end portion of the cord 62. The lock plate 63 is hooked between the switch housing 52 and the movable portion 53 of the emergency stop switch 51. The hook 64 is hooked around, for example, the right wrist of the ship operator.

Since the lock plate 63 is hooked between the switch housing 52 and the movable portion 53 of the emergency stop switch 51, a state in which the movable portion 53 moves upward from the switch housing 52 against a biasing force of the biasing member is maintained. In this state, a contact of the emergency stop switch 51 is turned off, for example. On the other hand, when the ship operator is far away from the console 4 due to, for example, falling into water, the lock plate 63 is pulled by the cord 62 and is disengaged between the switch housing 52 and the movable portion 53. When the lock plate 63 is disengaged between the switch housing 52 and the movable portion 53, the movable portion 53 moves downward by the biasing force of the biasing member. As a result, the contact of the emergency stop switch 51 is turned on, for example.

As shown in FIG. 7, the emergency stop switch 51 includes a communicator 55. The communicator 55 is attached to, for example, the switch housing 52. When the lock plate 63 is disengaged between the switch housing 52 and the movable portion 53, the movable portion 53 moves downward, and the contact of the emergency stop switch 51 is turned on, the communicator 55 wirelessly transmits an emergency stop command signal. The emergency stop command signal wirelessly transmitted from the communicator 55 is received by the wireless communication device 71 and transmitted from the wireless communication device 71 to the ECM of the outboard motor 3 via the signal transmission path. The ECM stops the engine of the outboard motor 3 according to the emergency stop command signal.

(Wireless Communication Device)

The wireless communication device 71 is a device that transmits signals or information between the ECM of the outboard motor 3 and the remote control device 11, the gauge device 31, or the emergency stop switch 51. As shown in FIG. 7, the wireless communication device 71 is configured to perform wireless communication with the communicators 21, 36, 55 respectively included in the remote control device 11, the gauge device 31, and the emergency stop switch 51, based on a short-range wireless communication standard such as Bluetooth (registered trademark). The harness 72 is connected to the wireless communication device 71, and an external connector 73 is connected to the harness 72. The external connector 73 is connected to the signal transmission path provided in the ship 1 via another connector connected to the external connector 73 and another harness connected to the corresponding another connector, and is connected to the ECM of the outboard motor 3 via the signal transmission path. The wireless communication device 71 receives the detection signal wirelessly transmitted from the communicator 21 of the remote control device 11, and transmits the detection signal to the ECM. The wireless communication device 71 receives the information on the outboard motor 3 output from the ECM and wirelessly transmits the information to the communicator 36 of the gauge device 31. The wireless communication device 71 receives the emergency stop command signal wirelessly transmitted from the communicator 55 of the emergency stop switch 51, and transmits the emergency stop command signal to the ECM.

The harness 72 includes a signal transmission cable for transmitting the detection signal, the information on the outboard motor 3, and the emergency stop command signal. The harness 72 further includes power supply cables for supplying power from a battery provided in the ship 1 to each of the remote control device 11, the gauge device 31, the emergency stop switch 51, and the wireless communication device 71. The power supply cables are connected to each of the remote control device 11, the gauge device 31, the emergency stop switch 51, and the wireless communication device 71, so that power from the battery is supplied to the angle sensor 20 and the communicator 21 of the remote control device 11, the gauge device 31, the emergency stop switch 51, and the wireless communication device 71. In FIG. 6, only a power supply cable 74 connected to the remote control device 11 is shown, and the power supply cables connected to the gauge device 31, the emergency stop switch 51, and the wireless communication device 71 are not shown.

(Case and Cap)

As shown in FIG. 3, the remote control device 11, the gauge device 31, and the emergency stop switch 51 are each attached to the case 81. The wireless communication device 71 is accommodated in the case 81. The remote control device 11, the gauge device 31, the emergency stop switch 51, and the wireless communication device 71 are integrated via the case 81, and are aggregated into the case 81.

As shown in FIG. 6, the case 81 includes a case body 82 and a bottom plate 90 attached to a lower side of the case body 82. The case body 82 is made of, for example, a resin material and is formed in a substantially box shape. As shown in FIG. 5, the case body 82 includes a substantially rectangular cylindrical base portion 83 having a stem side wall plate 83A, a left side wall plate 83B, a right side wall plate 83C, and a bow side wall plate 83D. As shown in FIG. 6, the case body 82 includes an accommodation portion 84 raised upward in an arch shape from a portion on a bow side of the base portion 83 in the front-rear direction, and a flat panel portion 85 covering an upper side of a portion on a stem side of the base portion 83 in the front-rear direction. A cylindrical left side attachment portion 87 is formed at a left portion of the accommodation portion 84, and a cylindrical right side attachment portion 88 is formed at a right portion of the accommodation portion 84. A window portion 86 is formed in the panel portion 85 so as to pass through the panel portion 85. The bottom plate 90 is formed of, for example, a resin material or a metal material in a flat plate shape. As shown in FIG. 5, the bottom plate 90 is attached to a lower portion of the base portion 83 of the case body 82, and substantially closes the entire base portion 83 from the lower side.

The remote control device 11 is attached to the left side attachment portion 87 of the case 81. Specifically, as shown in FIG. 6, a plurality of attachment bolt insertion holes 14 are formed in the holder 12 of the remote control device 11. A plurality of attachment bolt holes 89 are provided in the left side attachment portion 87 of the case 81 so as to respectively correspond to the plurality of attachment bolt insertion holes 14. The holder 12 is fixed to the left side attachment portion 87 by inserting attachment bolts 96 through the attachment bolt insertion holes 14 and fastening the attachment bolts 96 to the attachment bolt holes 89 of the left side attachment portion 87, so that the remote control device 11 is attached to the left side attachment portion 87.

In addition, the cap 93 is attached to the right side attachment portion 88 of the case 81. The cap 93 is formed in a cylindrical shape with a lid similarly to the holder 12 of the remote control device 11. A plurality of attachment bolt insertion holes 94 are formed in the cap 93 similarly to the holder 12. However, the shaft insertion hole 13 and the sensor fixing portion 15 formed in the holder 12 are not formed in the cap 93. The right side attachment portion 88 of the case 81 is provided with a plurality of attachment bolt holes similarly to the left side attachment portion 87. The cap 93 is fixed to the right side attachment portion 88 by inserting the attachment bolts 96 through the attachment bolt insertion holes 94 and fastening the attachment bolts 96 to the attachment bolt holes of the right side attachment portion 88.

Further, the gauge device 31 is attached to the stem side of the base portion 83 of the case 81 in the front-rear direction. Specifically, the gauge device 31 is fixed to an upper surface of the bottom plate 90, and the bottom plate 90 is fixed to the base portion 83, so that the gauge device 31 is accommodated inside a stem side portion of the base portion 83 in the front-rear direction. The gauge device 31 is disposed below the panel portion 85. The gauge device 31 is disposed such that the display screen of the display device 32 and the buttons 33 are located at a position corresponding to the window portion 86 of the panel portion 85. Therefore, the ship operator can visually recognize the display screen and operate the buttons 33 via the window portion 86.

The emergency stop switch 51 is attached to a left side of the gauge device 31 on the stem side of the base portion 83 of the case 81 in the front-rear direction. Specifically, in the panel portion 85, a switch attachment hole is formed on a left side of the window portion 86. The emergency stop switch 51 is fixed to the panel portion 85 by inserting an upper portion of the emergency stop switch 51 into the switch attachment hole from a lower side of the panel portion 85 and then fastening the fixing nut 54 to the upper portion of the emergency stop switch 51 from an upper side of the panel portion 85.

The wireless communication device 71 is accommodated in the accommodation portion 84 of the case 81. The wireless communication device 71 is fixed to the accommodation portion 84 or the bottom plate 90.

As shown in FIG. 5, a harness draw-out hole 91 for drawing out the harness 72 is formed in the bottom plate 90. The harness draw-out hole 91 penetrates the bottom plate 90. The harness 72 connected to the wireless communication device 71 accommodated in the case 81 is drawn out of the case 81 through the harness draw-out hole 91. The external connector 73 is connected to an end portion of the harness 72 drawn out of the case 81. As shown in FIG. 2B, the harness insertion hole 7 is provided in the upper plate of the console 4 on which the attachment surface 5 is formed. When the operation apparatus 10 is attached to the attachment surface 5 of the console 4, the harness draw-out hole 91 and the harness insertion hole 7 correspond to each other. The harness 72 and the external connector 73 drawn out of the case 81 from the harness draw-out hole 91 pass through the harness insertion hole 7 of the console 4 and are disposed inside the console 4. The external connector 73 is connected to the another connector for connecting the external connector 73 to the ECM inside the console 4.

A plurality of fixing bolt holes 92 through which the operation apparatus 10 is fixed to the attachment surface 5 of the console 4 are formed in the bottom plate 90. As shown in FIG. 2B, the plurality of fixing bolt insertion holes 6 are provided in the upper plate of the console 4 on which the attachment surface 5 is formed so as to correspond to the plurality of fixing bolt holes 92 of the bottom plate 90. The operation apparatus 10 is fixed to the attachment surface 5 of the console 4 by using the plurality of fixing bolts 95. For example, the operation apparatus 10 is fixed to the attachment surface 5 by inserting the fixing bolts 95 through the fixing bolt insertion holes 6 from a lower side of the upper plate of the console 4 on which the attachment surface 5 is formed, and then fastening the fixing bolts 95 to the fixing bolt holes 92 of the bottom plate 90.

As shown in FIG. 2A, in a state where the operation apparatus 10 is attached to the attachment surface 5 of the console 4, in the case 81, the remote control device 11 and the gauge device 31 are disposed adjacently to each other in the front-rear direction of the ship 1. The remote control device 11 and the emergency stop switch 51 are also disposed adjacently to each other in the front-rear direction of the ship 1. The gauge device 31 and the emergency stop switch 51 are disposed closer to the stem side of the ship 1 as compared with the remote control device 11. In addition, the remote control device 11 is disposed at a portion of the case 81 close to the steering wheel 9, specifically, at a left side portion of the case 81. The gauge device 31 and the emergency stop switch 51 are adjacently to each other in the left-right direction of the ship 1. The emergency stop switch 51 is disposed at a position closer to the steering wheel 9 as compared with the gauge device 31, specifically, on the left side of the gauge device 31. The emergency stop switch 51 is disposed at a position avoiding the range in which the operation lever 16 of the remote control device 11 can be moved. Specifically, the emergency stop switch 51 is disposed on a right side of the operation lever 16 of the remote control device 11, so that when the ship operator tilts the operation lever 16 to the near side (stem side), the operation lever 16 does not come into contact with the emergency stop switch 51.

In the operation apparatus 10 according to the first embodiment of the invention having the above configuration, as shown in FIG. 2A, the remote control device 11, the gauge device 31, and the emergency stop switch 51 can be provided on the attachment surface 5 by attaching the case 81, in which the remote control device 11, the gauge device 31, and the emergency stop switch 51 are aggregated so as to be integrated, to the attachment surface 5 of the console 4. As shown in FIG. 2B, in the operation apparatus 10, an overall attachment area of the remote control device 11, the gauge device 31, and the emergency stop switch 51 on the attachment surface 5 is equal to an attachment area M1 of the case 81 on the attachment surface 5.

Figure 10A:
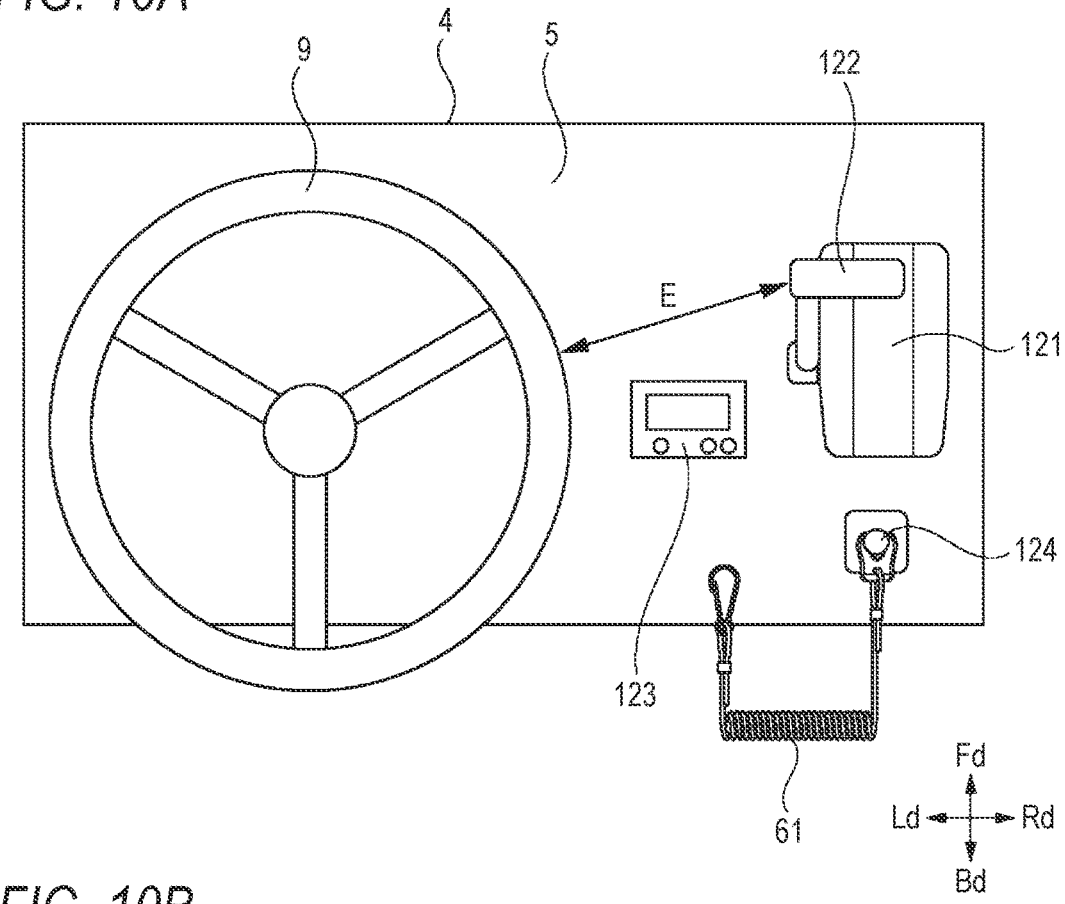
FIGS. 10A and 10B illustrate views of states in which a console of a ship provided with an independent remote control device, an independent gauge device, and an independent emergency stop switch is viewed from the upper side, more specifically.
Figure 10B:
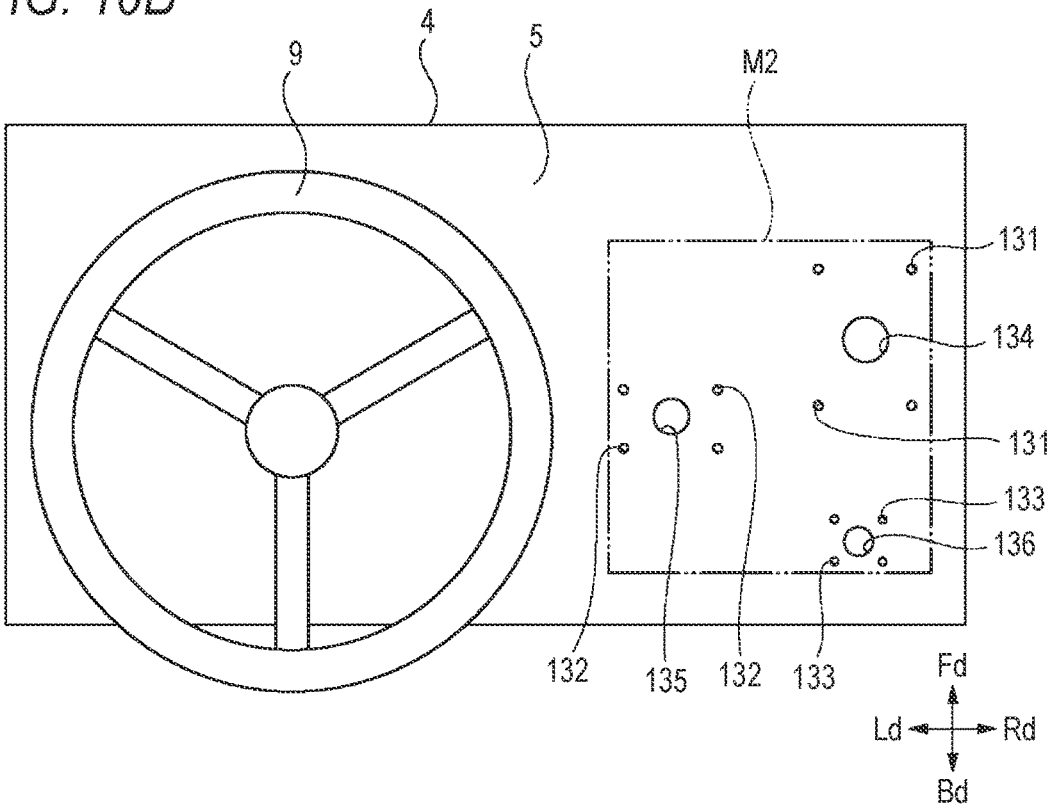

Here, FIG. 10A shows a state in which an independent remote control device 121, an independent gauge device 123, and an independent emergency stop switch 124 are separately attached to the attachment surface 5 of the console 4 so as to be separated from each other in the related art. FIG. 10B shows a state in which these devices are not yet attached to the attachment surface 5 to which the remote control device 121, the gauge device 123, and the emergency stop switch 124 are to be attached as shown in FIG. 10A. In addition, M2 in FIG. 10B indicates an overall attachment area of the remote control device 121, the gauge device 123, and the emergency stop switch 124.

As can be seen from a comparison between FIG. 2B and FIG. 10B, the attachment area M1 of the case 81 of the operation apparatus 10, that is, the overall attachment area of the remote control device 11, the gauge device 31, and the emergency stop switch 51 in the operation apparatus 10 is smaller than the overall attachment area M2 of the remote control device 121, the gauge device 123, and the emergency stop switch 124 in the related art. As described above, according to the operation apparatus 10 of the present embodiment, the remote control device 11, the gauge device 31, and the emergency stop switch 51 are aggregated via the case 81 so as to be integrated, and thus, it is possible to reduce the attachment area of the remote control device 11, the gauge device 31, and the emergency stop switch 51 on the attachment surface 5 of the console 4 as compared with the related art. Therefore, when the operation apparatus 10 is provided on a console of a ship, a large console is not necessary, and an increase in size of the console can be prevented.

Further, according to the operation apparatus 10 of the present embodiment, in addition to the remote control device 11 and the gauge device 31 being aggregated via the case 81 so as to be integrated, the remote control device 11 and the gauge device 31 are disposed adjacently to each other in the front-rear direction of the ship 1, and thus, an operation area for the ship operator operating the ship can be reduced, and a distance for the ship operator moving his/her arm to operate the ship can be reduced.

Specifically, in the related art, as shown in FIG. 10A, since the gauge device 123 is disposed between the steering wheel 9 and the remote control device 121, the remote control device 121 is away from the steering wheel 9. Therefore, a distance E between the steering wheel 9 and the operation lever 122 of the remote control device 121 tends to increase.

In contrast, in the operation apparatus 10 according to the present embodiment, as shown in FIG. 2A, the remote control device 11 and the gauge device 31 are disposed adjacently to each other in the front-rear direction of the ship 1, and thus, when the operation apparatus 10 is disposed on the lateral side of the steering wheel 9, the gauge device 31 is not positioned between the steering wheel 9 and the remote control device 11. Therefore, the operation apparatus 10 can be disposed on the lateral side of the steering wheel 9 so as to be close to the steering wheel 9, and thus a distance D between the steering wheel 9 and the operation lever 16 of the remote control device 11 can be reduced.

When the distance D between the steering wheel 9 and the operation lever 16 of the remote control device 11 is reduced, a distance by which the arm moves to left or right when the ship operator alternately performs the steering operation by the steering wheel 9, the shift switching operation by the remote control device 11, and the like decreases, thereby improving operability. In addition, even when the ship operator repeats the movement of the arm in order to alternately perform the steering operation, the shift switching operation, and the like, the movement of the arm is reduced, and thus the cord 62 connecting the ship operator and the emergency stop switch 51 is less likely to be entangled.

In addition, according to the operation apparatus 10 of the present embodiment, by attaching the case 81 to the attachment surface 5 of the console 4, the remote control device 11, the gauge device 31, and the emergency stop switch 51 integrated via the case 81 can be provided on the attachment surface 5, and therefore, it is possible to improve workability of attaching the remote control device 11, the gauge device 31, and the emergency stop switch 51 to the console 4.

Specifically, in the related art, as shown in FIG. 10A, the remote control device 121, the gauge device 123, and the emergency stop switch 124 are independent of each other, and these devices are separately attached to the attachment surface 5 of the console 4. Therefore, as shown in FIG. 10B, holes 131 through which fixing members (for example, bolts) for fixing the remote control device 121 to the attachment surface 5 pass, holes 132 through which fixing members for fixing the gauge device 123 to the attachment surface 5 pass, and holes 133 through which fixing members for fixing the emergency stop switch 124 to the attachment surface 5 pass must be each provided in the attachment surface 5. In addition, in the related art, since the remote control device 121, the gauge device 123, and the emergency stop switch 124 are separately disposed on the attachment surface 5, a hole 134 through which a cable (specifically, the signal transmission cable and the power supply cable) connected to the remote control device 121 passes, a hole 135 through which a cable connected to the gauge device passes, and a hole 136 through which a cable connected to the emergency stop switch 124 passes must be each provided on the attachment surface 5. As a result, a large number (for example, 15) of holes are provided in the attachment surface 5.

In contrast, in the operation apparatus 10 according to the present embodiment, since the remote control device 11, the gauge device 31, and the emergency stop switch 51 are integrated via the case 81, as shown in FIG. 2B, it is sufficient to provide, in the attachment surface 5, holes (for example, four fixing bolt insertion holes 6) through which fixing members (fixing bolts 95) for fixing the case 81 to the attachment surface 5 of the console 4 pass. In addition, in the operation apparatus 10, since the remote control device 11, the gauge device 31, the emergency stop switch 51, and the wireless communication device 71 are integrated via the case 81, it is easy to bundle the power supply cable connected to the remote control device 11, the power supply cable connected to the gauge device 31, the power supply cable connected to the emergency stop switch 51, the power supply cable connected to the wireless communication device 71, and the signal transmission cable connected to the wireless communication device 71 into one harness 72. Therefore, it is sufficient to provide one hole (harness insertion hole 7) through which one harness 72 passes in the attachment surface 5. Therefore, according to the operation apparatus 10 of the present embodiment, when the remote control device 11, the gauge device 31, and the emergency stop switch 51 are provided on the attachment surface 5 of the console 4, the number of holes provided in the attachment surface 5 can be reduced to, for example, five, and therefore, it is possible to improve the workability of attaching the remote control device 11, the gauge device 31, and the emergency stop switch 51 to the console 4.

Further, in the operation apparatus 10 according to the present embodiment, the emergency stop switch 51 is disposed on the stem side of the remote control device 11 and on the left side of the gauge device 31. Accordingly, the emergency stop switch 51 can be brought close to the ship operator who operates the ship in front of the console 4, and the emergency stop switch 51 can be brought close to the steering wheel 9. By bringing the emergency stop switch 51 close to the ship operator and the steering wheel 9, even when the ship operator repeats movement of the right arm to operate the ship, a distance by which the cord 62 is moved is reduced, and a degree of extension and contraction of the cord 62 becomes small, and thus, the cord 62 is less likely to be entangled.

The operation apparatus 10 according to the present embodiment includes the wireless communication device 71, the detection signal is wirelessly transmitted from the communicator 21 of the remote control device 11 to the wireless communication device 71, the information on the outboard motor 3 is wirelessly transmitted from the wireless communication device 71 to the communicator 36 of the gauge device 31, and the emergency stop command signal is wirelessly transmitted from the communicator 55 of the emergency stop switch 51 to the wireless communication device 71. With this configuration, in the operation apparatus 10, a signal transmission cable that connects the angle sensor 20 of the remote control device 11 and the external connector 73, a signal transmission cable that connects the gauge device 31 and the external connector 73, and a signal transmission cable that connects the emergency stop switch 51 and the external connector 73 become unnecessary. Therefore, it is possible to prevent complication of wiring in the case 81, and it is possible to facilitate assembly of the operation apparatus 10.

(Replacement of Remote Control Device)

Figure 8A:
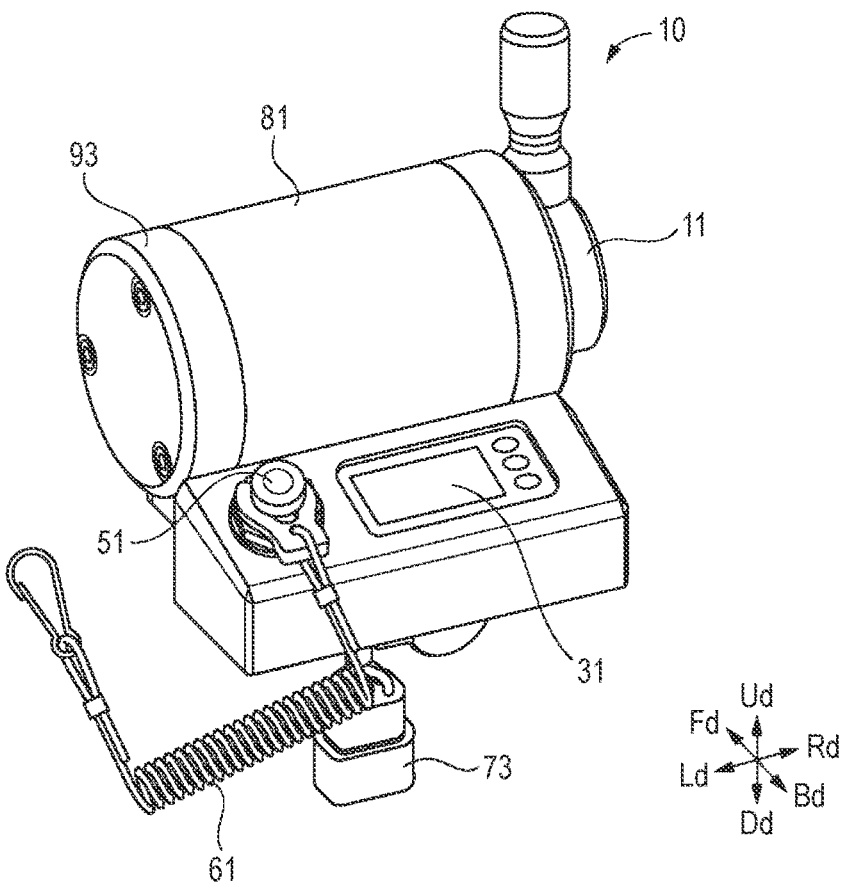
FIG. 8A illustrates views of an operation apparatus according to a modified embodiment of the operation apparatus according to the first embodiment of the invention.

In the operation apparatus 10 according to the present embodiment, as shown in FIG. 3, the remote control device 11 is attached to the left side portion of the case 81, but as shown in FIG. 8A, the remote control device 11 can also be attached to a right side portion of the case 81. That is, in the case 81, the left side attachment portion 87 and the right side attachment portion 88 have shapes and structures symmetrical to each other in the left-right direction. Further, the plurality of attachment bolt holes 89 formed in the left side attachment portion 87 are disposed symmetrically in the front-rear direction, and the plurality of attachment bolt holes 89 formed in the right side attachment portion 88 are also disposed symmetrically in the front-rear direction. The plurality of attachment bolt insertion holes 14 formed in the holder 12 are disposed symmetrically in the front-rear direction, and the plurality of attachment bolt insertion holes 94 formed in the cap 93 are also disposed symmetrically in the front-rear direction. Therefore, as indicated by a two-dot chain line in FIG. 6, the remote control device 11 can be attached not only to the left side attachment portion 87 but also to the right side attachment portion 88. Whether the remote control device 11 is attached to the left side attachment portion 87 or the right side attachment portion 88 can be freely selected by a manufacturer or a user. When one remote control device 11 is attached to the left side attachment portion 87, the cap 93 is attached to the right side attachment portion 88. When one remote control device 11 is attached to the right side attachment portion 88, the cap 93 is attached to the left side attachment portion 87.

Further, orientations of the remote control device 11 in the front-rear direction are reversed between the case where the remote control device 11 is attached to the left side attachment portion 87 and the case where the remote control device 11 is attached to the right side attachment portion 88. Therefore, it is necessary to reverse the forward movement position F, the reverse movement position R, the rotation speed operation range Cf, and the rotation speed operation range Cr in the case where the remote control device 11 is attached to the left side attachment portion 87 and in the case where the remote control device 11 is attached to the right side attachment portion 88. The remote control device 11 is provided with the setting selector switch 22 that reverses the setting of the forward movement position F, the reverse movement position R, the rotation speed operation range Cf, and the rotation speed operation range Cr between the case where the remote control device 11 is attached to the left side attachment portion 87 and the case where the remote control device 11 is attached to the right side attachment portion 88. The manufacturer or the user can switch the setting of the forward movement position F, the reverse movement position R, the rotation speed operation range Cf, and the rotation speed operation range Cr by operating the setting selector switch 22.

As described above, according to the operation apparatus 10 of the present embodiment, when the operation apparatus 10 is disposed on the right side of the steering wheel 9, the operation lever 16 of the remote control device 11 can be brought close to the steering wheel 9 by attaching the remote control device 11 to the left side portion of the case 81, and on the other hand, when the operation apparatus 10 is disposed on a left side of the steering wheel 9, the operation lever 16 of the remote control device 11 can be brought close to the steering wheel 9 by attaching the remote control device 11 to the right side portion of the case 81. Therefore, no matter the operation apparatus 10 is disposed on the right side or the left side of the steering wheel 9, the operability of the operation apparatus 10 can be improved.

Other Embodiments

Figure 8B:
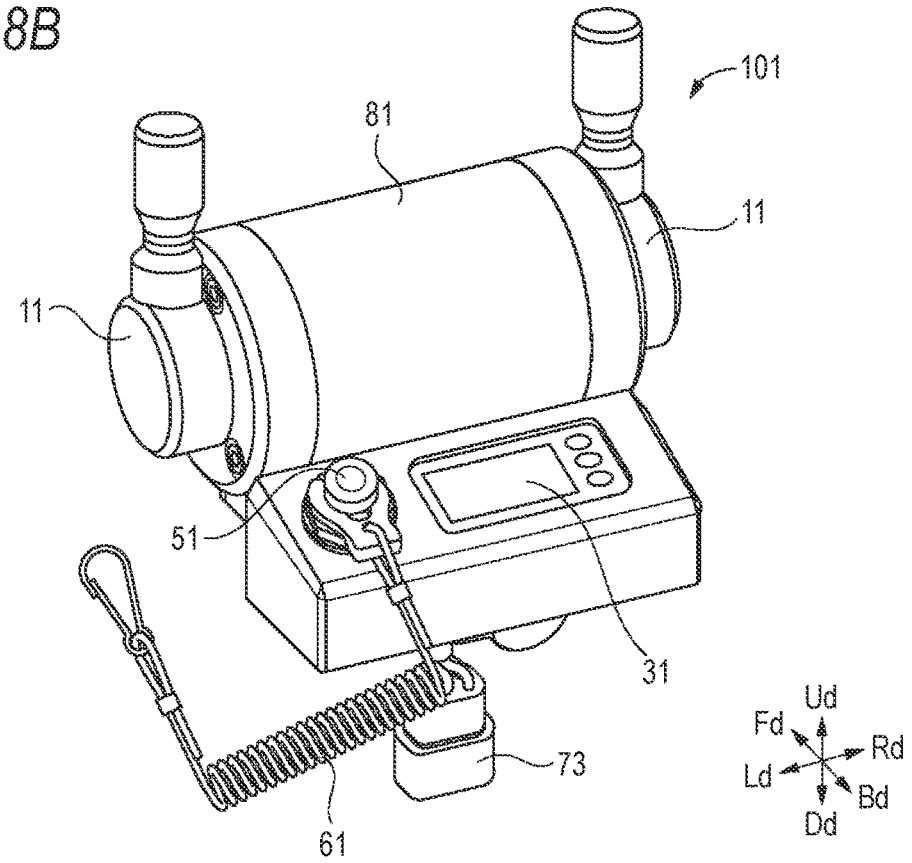
FIG. 8B illustrates views of an operation apparatus according to a second embodiment of the invention.

FIG. 8B shows an operation apparatus 101 according to a second embodiment of the invention. The operation apparatus 101 is constituted by adding one remote control device 11 to the operation apparatus 10 according to the first embodiment described above. In the operation apparatus 101, the two remote control devices 11, the gauge device 31, and the emergency stop switch 51 are aggregated via the case 81 so as to be integrated. When the ship is a two-propeller ship, the ship operator can each operate the two outboard motors 3 provided in the ship by using the two remote control devices 11 of the operation apparatus 101. The operation apparatus 101 can be easily assembled by attaching one remote control device 11 to the left side attachment portion 87 of the case 81 and attaching the other remote control device 11 to the right side attachment portion 88 of the case 81.

According to the operation apparatus 101 of the second embodiment of the invention, the two remote control devices 11, the gauge device 31, and the emergency stop switch 51 are aggregated via the case 81 so as to be integrated, and thus, it is possible to reduce an attachment area of the two remote control devices 11, the gauge device 31, and the emergency stop switch 51 on the attachment surface 5 of the console 4. In addition, according to the operation apparatus 101 of the second embodiment of the invention, similarly to the operation apparatus 10 according to the first embodiment of the invention, it is possible to reduce the operation area for the ship operator operating the ship, and it is possible to improve workability of attaching the two remote control devices 11, the gauge device 31, and the emergency stop switch 51 to the console 4.

Figure 9A:
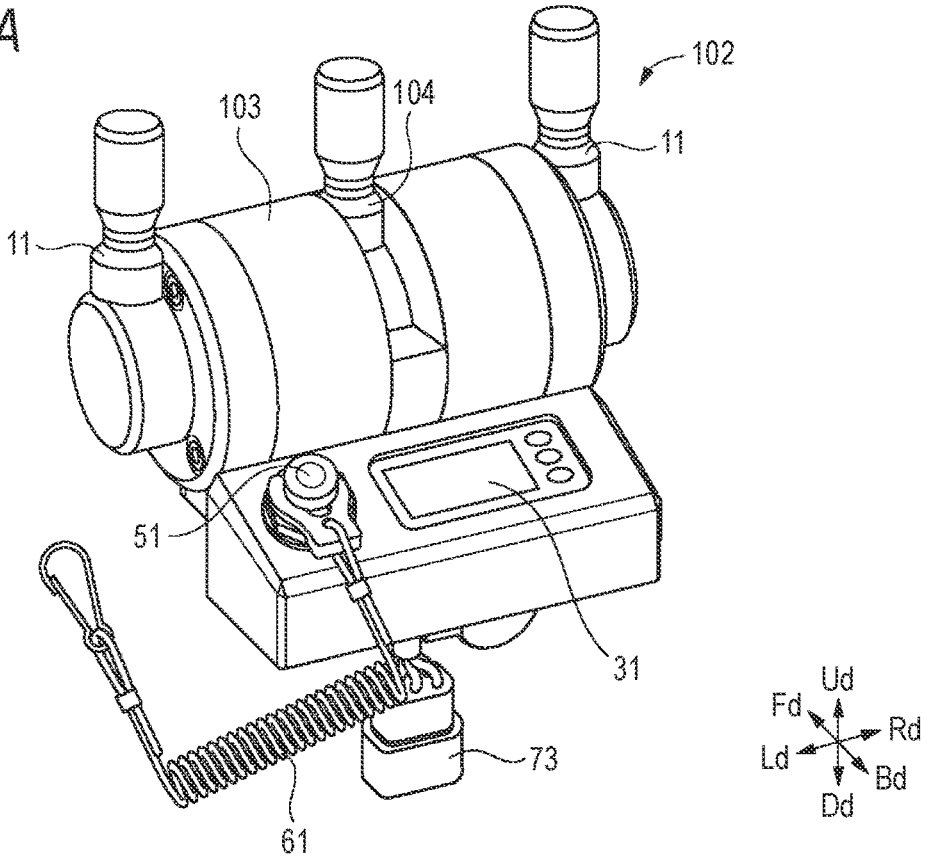
FIG. 9A illustrates views of an operation apparatus according to a third embodiment of the invention.
Figure 9B:
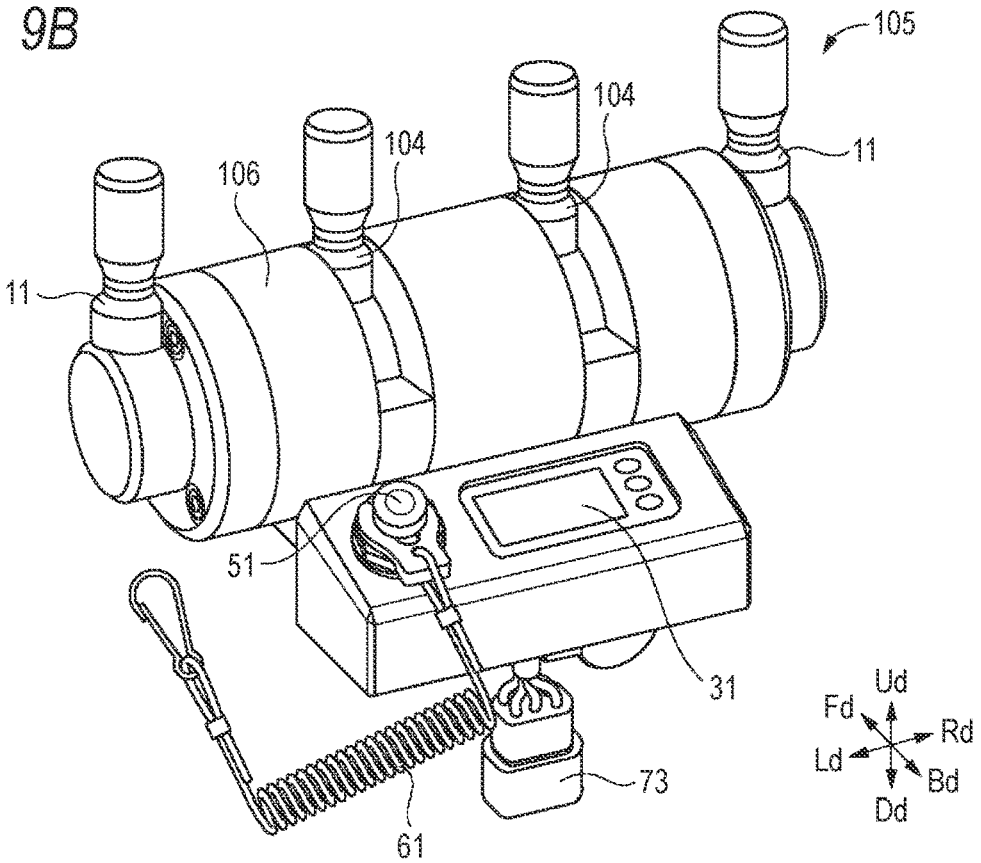
FIG. 9B illustrates views of an operation apparatus according to a fourth embodiment of the invention.

FIG. 9A shows an operation apparatus 102 according to a third embodiment of the invention. The operation apparatus 102 is formed by aggregating three remote control devices 11, 11, 104, the gauge device 31, and the emergency stop switch 51 via a case 103 so as to be integrated. FIG. 9B shows an operation apparatus 105 according to a fourth embodiment of the invention. The operation apparatus 105 is formed by aggregating four remote control devices 11, 11, 104, 104, the gauge device 31, and the emergency stop switch 51 via a case 106 so as to be integrated. According to the operation apparatus 102 or 105 of the third or fourth embodiment of the invention, it is possible to obtain substantially the same operations and effects as those of the first or second embodiment of the invention. Further, in the operation apparatus 102 according to the third embodiment, by replacing one of a leftmost remote control device 11 and a rightmost remote control device 11 with the cap 93, it is possible to easily convert the operation apparatus including the three remote control devices 11, 11, 104 into the operation apparatus including the two remote control devices 11, 104. Further, in the operation apparatus 102 according to the third embodiment, by replacing both the leftmost remote control device 11 and the rightmost remote control device 11 with the cap 93, it is possible to easily convert the operation apparatus including the three remote control devices 11, 11, 104 into the operation apparatus including the remote control device 104. Similarly, also in the operation apparatus 105 according to the fourth embodiment, it is possible to easily change the number of remote control devices.

In each of the above embodiments, the case where the wireless communication device 71 that wirelessly communicates with each of the remote control device 11 (104), the gauge device 31, and the emergency stop switch 51 is provided is described as an example, but the wireless communication device 71 may not be provided. In that case, the operation apparatus 10 is provided with the signal transmission cable that connects the angle sensor 20 of the remote control device 11 (104) and the external connector 73, the signal transmission cable that connects the gauge device 31 and the external connector 73, and the signal transmission cable that connects the emergency stop switch 51 and the external connector 73. These signal transmission cables can be bundled together with a power supply cable to form one harness 72, and can be drawn out from the inside of the case 81 to the outside of the case 81 through the harness draw-out hole 91.

In each of the above embodiments, the emergency stop switch 51 is integrated with the remote control device 11 (104) and the gauge device 31 via the case 81, but the emergency stop switch 51 may be removed from the operation apparatus 10.

In addition, as the third and fourth embodiments according to the invention, the operation apparatus 102 including three remote control devices and the operation apparatus 105 including four remote control devices are described, but the operation apparatus according to the invention may include five or more remote control devices.

In each of the above embodiments, the case where the outboard motor is operated by the operation apparatus 10 is described as an example, but the invention is not limited thereto. The operation apparatus according to the invention can also be applied to an operation apparatus for operating an inboard-outboard motor or an inboard motor. The ship provided with the operation apparatus according to the invention is not limited to the small ship as shown in FIG. 1, and may be a medium-sized ship or a large-sized ship.

The power source of the ship propulsion machine is not limited to the engine, and may be an electric motor. When the power source of the ship propulsion machine is an electric motor, the shift switching operation performed by the remote control device means an operation of switching a rotation direction of a rotor of the electric motor, and the information indicating the shift position in the gauge device means information indicating the rotation direction of the rotor of the electric motor.

In addition, each of the above embodiments describes, as an example, that in the remote control device 11 (104), the detection signal indicating the swing angle of the operation lever 16 with respect to the holder 12 is wirelessly transmitted from the communicator 21 to the wireless communication device 71 as the signal corresponding to the swing angle of the operation lever with respect to the holder, but instead, in response to the operation of the operation lever 16, the signal indicating the shift operation position N, F, or R, or the signal indicating an operation amount in the rotation speed operation range Cf or Cr may be wirelessly transmitted from the communicator 21 to the wireless communication device 71 as the signal corresponding to the swing angle of the operation lever with respect to the holder.

The invention can be modified as appropriate without departing from the scope or spirit of the invention which can be read from the claims and the entire description, and the operation apparatus accompanying such a change is also included in the technical concept of the invention.

What is claimed is:

1. An operation apparatus configured to operate a ship propulsion machine provided in a ship, the ship including a console provided with a steering device configured to perform a steering operation of the ship, the operation apparatus comprising:

a remote control device including a holder and an operation lever swingably supported by the holder, and configured to perform, by the operation lever, a shift switching operation of the ship propulsion machine and an operation of increasing/decreasing a rotation speed of a power source of the ship propulsion machine;

a gauge device including a display device and configured to display, on the display device, information on the ship propulsion machine including information indicating a shift position of the ship propulsion machine and information indicating the rotation speed of the power source;

a case to which the remote control device and the gauge device are each attached, and which integrates the remote control device and the gauge device, the case being configured to be attached to the console of the ship; and an emergency stop switch configured to be connected to a ship operator of the ship via a cord and configured to perform an emergency stop on the power source, wherein in the case, the remote control device and the gauge device are disposed adjacently to each other in a front-rear direction of the ship, and wherein the emergency stop switch is attached to the case, and is integrated with the remote control device and the gauge device via the case.

2. The operation apparatus according to claim 1, wherein the operation apparatus is provided on a lateral side of the steering device on the console, and in the case, the gauge device and the emergency stop switch are disposed on a stern side of the ship with respect to the remote control device, the gauge device and the emergency stop switch are adjacently to each other in a left-right direction of the ship, and the emergency stop switch is disposed at a position closer to the steering device as compared with the gauge device.

3. An operation apparatus configured to operate a ship propulsion machine provided in a ship, the ship including a console provided with a steering device configured to perform a steering operation of the ship, the operation apparatus comprising:

a remote control device including a holder and an operation lever swingably supported by the holder, and configured to perform, by the operation lever, a shift switching operation of the ship propulsion machine and an operation of increasing/decreasing a rotation speed of a power source of the ship propulsion machine;

a gauge device including a display device and configured to display, on the display device, information on the ship propulsion machine including information indicating a shift position of the ship propulsion machine and information indicating the rotation speed of the power source; and a case to which the remote control device and the gauge device are each attached, and which integrates the remote control device and the gauge device, the case being configured to be attached to the console of the ship, wherein in the case, the remote control device and the gauge device are disposed adjacently to each other in a front-rear direction of the ship, wherein the case includes a right side attachment portion which is provided on a right portion of the case and to which the remote control device is attachable, and a left side attachment portion which is provided on a left portion of the case and to which the remote control device is attachable, and the remote control device is selectively attachable to the right side attachment portion or the left side attachment portion.

4. An operation apparatus configured to operate a ship propulsion machine provided in a ship, the ship including a console provided with a steering device configured to perform a steering operation of the ship, the operation apparatus comprising:

a remote control device including a holder and an operation lever swingably supported by the holder, and configured to perform, by the operation lever, a shift switching operation of the ship propulsion machine and an operation of increasing/decreasing a rotation speed of a power source of the ship propulsion machine;

a gauge device including a display device and configured to display, on the display device, information on the ship propulsion machine including information indicating a shift position of the ship propulsion machine and information indicating the rotation speed of the power source;

a case to which the remote control device and the gauge device are each attached, and which integrates the remote control device and the gauge device, the case being configured to be attached to the console of the ship; and a plurality of remote control devices including holders and operation levers swingably supported by the holders, and configured to perform, by the operation levers, shift switching operations of ship propulsion machines and operations of increasing/decreasing rotation speeds of power sources of the ship propulsion machines, wherein in the case, the remote control device and the gauge device are disposed adjacently to each other in a front-rear direction of the ship, and wherein the remote control devices are attached to the case.

5. The operation apparatus according to claim 1, wherein the remote control device is provided with a communicator configured to wirelessly transmit a signal corresponding to a swing angle of the operation lever with respect to the holder, and the case is provided with a wireless communication device configured to receive the signal wirelessly transmitted from the communicator and output the signal to the ship propulsion machine.

* * * * *